US005317770A

United States Patent [19]

Sakurai

[11] Patent Number: 5,317,770

[45] Date of Patent: Jun. 7, 1994

[54] EMERGENCY STRETCHER AND TEMPORARY BED

[75] Inventor: Kazutoshi Sakurai, Nagano, Japan

[73] Assignee: Cappy Sakurai U.S.A., Inc., Knoxville, Tenn.

[21] Appl. No.: 969,781

[22] Filed: Oct. 30, 1992

[30] Foreign Application Priority Data

Nov. 11, 1991 [JP] Japan ..... 3-100648[U]

[51] Int. Cl.[5] ..... A61G 1/00

[52] U.S. Cl. ..... 5/625; 5/628; 5/450

[58] Field of Search ..... 5/81.1, 89.1, 625, 627, 5/628, 450; 294/140

[56] References Cited

U.S. PATENT DOCUMENTS

| | | | |
|---|---|---|---|
| Re. 28,916 | 7/1976 | Rice | 5/625 |
| 722,456 | 3/1903 | Reeves . | |
| 1,263,918 | 4/1918 | Miller | 5/625 |
| 2,682,670 | 7/1954 | Crump | 5/625 |
| 2,788,530 | 4/1957 | Ferguson . | |
| 3,264,659 | 8/1966 | Magni | 5/625 |
| 3,935,690 | 2/1976 | Lea et al. . | |
| 4,124,908 | 11/1978 | Burns et al. . | |
| 4,283,068 | 8/1981 | Keyser . | |
| 4,621,382 | 11/1986 | Burriss | 5/625 |
| 4,679,260 | 7/1987 | Frettem | 5/627 |
| 4,723,327 | 2/1988 | Smith | 5/625 |
| 5,014,374 | 5/1991 | Williams . | |
| 5,044,031 | 9/1991 | Sherwood | 5/625 |
| 5,121,514 | 6/1992 | Rosane . | |

FOREIGN PATENT DOCUMENTS

| | | | |
|---|---|---|---|
| 50-27691 | 3/1975 | Japan . | |
| 51-55597 | 4/1976 | Japan . | |
| 51-144097 | 11/1976 | Japan . | |
| 51-163797 | 12/1976 | Japan . | |
| 52-105992 | 8/1977 | Japan . | |
| 54-172595 | 12/1979 | Japan . | |
| 5864322 | 4/1986 | Japan . | |
| 61-203023 | 12/1986 | Japan . | |
| 62-142363 | 9/1987 | Japan . | |
| 62-194335 | 12/1987 | Japan . | |
| 1-104127 | 7/1989 | Japan . | |
| 428124 | 7/1967 | Switzerland | 5/450 |
| 2050844 | 6/1981 | United Kingdom | 5/625 |
| 2213734 | 8/1989 | United Kingdom | 5/89.1 |

*Primary Examiner*—Flemming Saether

*Attorney, Agent, or Firm*—Luedeka, Hodges, Neely & Graham

[57] ABSTRACT

An object of the present invention is to provide a collapsible stretcher. The stretcher comprises: a mattress section having a rectangular shape, the mattress section being made of a material, which is capable of absorbing air, the mattress section being capable of spreading by absorbing air and being wound from a longitudinal end when air is discharged; a cover section for accommodating the mattress section, the cover section having a rectangular shape; belt holders being provided on both longitudinal edges of the cover section; and a belt being run through the belt holders, the belt being formed into a loop. Having the windable and light mattress section and no long shafts, the stretcher can be easily and rapidly managed even in narrow places.

9 Claims, 5 Drawing Sheets

EMERGENCY STRETCHER AND TEMPORARY BED

BACKGROUND OF THE INVENTION

The present invention relates to a stretcher and a bed.

A conventional stretcher, which has a pair of shafts and a cloth section stretched between the shafts, has been well known. A man to be carried. e.g. a patient, is laid down on the cloth section, and carrier persons rip end sections of the shafts so as to lift and carry him.

However, the conventional stretcher has following disadvantages:

Firstly, the conventional stretcher is bulky, and a large accommodation space is required because the shafts are not collapsible. Further, with such long shafts, it is difficult to go up and down stairs and to turn at a narrow entrance or on a narrow aisle. Practically, the conventional stretcher can not be used in such narrow places.

Secondly, a plurality of carrier persons are required to manage the conventional stretcher. Therefore, it is impossible to carry a patient by one carrier person.

Thirdly, the cloth section of the conventional stretcher has no elasticity, so a patient must be transferred from the stretcher to a mattress on a bed after the a patient is carried to a destination. To transfer the patient to the bed is troublesome, and the mattress must be previously set on the bed.

SUMMARY OF THE INVENTION

An object of the present invention is to provide a collapsible stretcher for which a smaller accommodation space is required.

Another object is to provide a stretcher, which can be managed by one carrier person.

Further object is to provide a stretcher, which can be used as a mattress.

The inventor has studied to achieve the objects, and has thought of using a mattress. Especially, he thought that a shrinkable mattress made of materials, which can be spread by absorbing air, is preferable.

Namely, a stretcher of the present invention comprises:

a mattress section having a rectangular shape, the mattress section being made of a material, which is capable of absorbing air, the mattress section being capable of spreading by absorbing air and being wound from a longitudinal end when air is discharged:

a cover section for accommodating the mattress section, the cover section having a rectangular shape;

belt holders being provided on both longitudinal edges of the cover section; and a bet being run through the belt holders, the bet being formed into a loop.

By the mattress section and no ion shafts, the stretcher can be easily and rapidly managed in narrow places. The mattress section can be spread by absorbing air, and wound when air absorbed is discharged, so that the mattress section can be light and compact. Furthermore, a carrier person(s) is capable of easily managing the stretcher by shouldering the belt.

The stretcher may have a grip section(s) at one or both longitudinal ends of he cover section. And the stretcher may have four grip sections provided at each corner of the cover section, and each pair of the grip sections, which are diagonally provided, may be connected by a connecting belt, which is fixed on the cover section. By the grip sections carrier persons can easily lift and carry the stretcher.

The stretcher may have a leg-bag section for accommodating man's legs provide at one longitudinal end of the cover section. By the leg-bag section, a man can be stably-carried on the stretcher. Note that, the leg-bag section may have a first openable section in the center part and first fastening means for opening and closing the first openable section on an edge of the first openable section.

Furthermore, the stretcher may have a body-bag section or accommodating man's body provided on an upper face of the cover section. The body-ba section has a second openable section in the center part and second fastened means for opening and closing the second openable section provided on an edge of the second openable section. By the body-bag section, a man to be carried can be stably accommodated therein.

The stretcher of the present invention can be adopted to a bed. The bed comprises:

a mattress section having a rectangular shape, the mattress section being made of a material, which is capable of absorbing air, the mattress section being capable of spreading by absorbing air and being wound from a longitudinal end when air is discharged;

a cover section for accommodating the mattress section, the cover section having a rectangular shape;

shaft holders being provided on both longitudinal edges of the cover section;

a pair of shafts being pierced through the shaft holders;

supporting means for supporting the shaft: and holding means for securing the span between the shafts at predetermined distance.

BRIEF DESCRIPTION OF THE DRAWINGS

Embodiments of the present invention wil now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
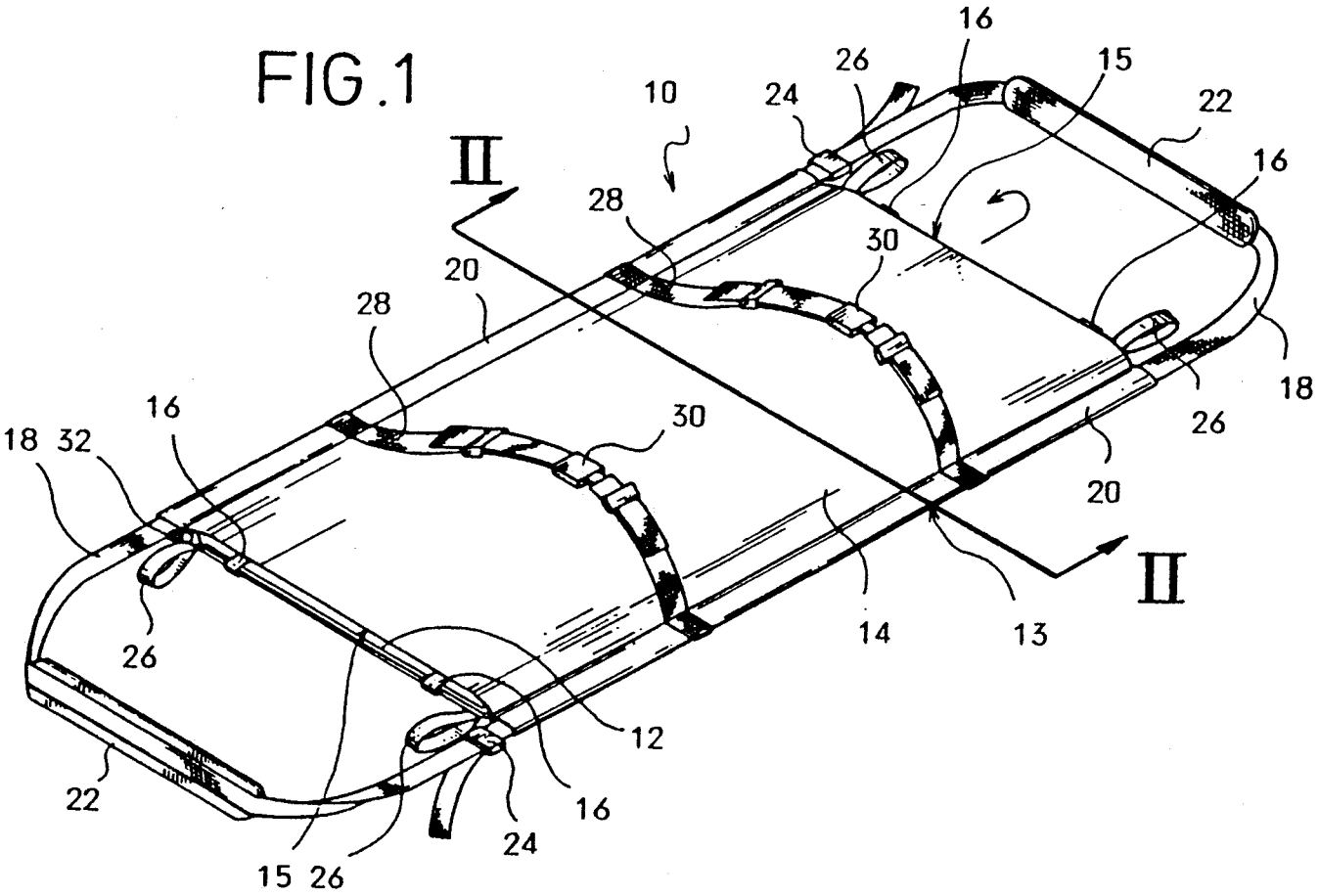
FIG. 1 is a perspective view of a stretcher of an embodiment.
Figure 2:
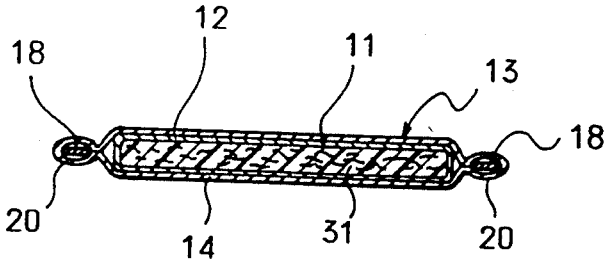
FIG. 2 is a transverse sectional view of the stretcher taken along line II—II of FIG. 1.

FIG 1 is a perspective view of a stretcher of a first embodiment. FIG. 2 is a transverse sectional view thereof.

A stretcher proper 13 has a mattress section 12 and a cover section 1, which is made of a water- and fire-proof sheet material and which covers over the mattress section 12. Both longitudinal edges of the cover section 1 are closed; both transverse edges thereof are opened. There are provided holders 16, 16, 16 and 16, which hold the mattress section 12 in the cover section 14, on edges of both openings 15 and 15.

There are provided cylindrical belt holder 20 and 20 on both longitudinal edges of the stretcher proper 13. Shoulder belts 18 and 18 are run through the belt holders 20 and 20. Each end of the shoulder belts 18 and 18 are mutually connected to form into a loop. There are provided shoulder pads 22 and 22 on inner faces of the looped shoulder belts 18 and 18. Parts, where the shoulder pads 22 and 22 are provided, are outwardly extended from the belt holders 20 and 20.

There are provided clasps 24 and 24 for adjusting the loop length of the looped shoulder belts 18 and 18 on each shoulder belt 18 and 18.

There are provided looped grip sections 26, 26, 26 and 26 on edges of the openings 15 and 15 of the stretcher proper 13. The grip sections 26, 26, 26 and 26 are sewn on a bottom face of the cover section 14.

There are provided holding belts 28 and 28 on an upper face of the cover section 14. The holding belts 28 and 28 are mutually separated away in the longitudinal direction of the stretcher proper 13. Both ends of each holding belt 28 and 28 are sewed on the belt holders 20 and 20.

There are provided buckles 30 and 30 at mid sections of the holding belts 28 and 28. The buckles 30 and 30 are capable of fastening the holding belts 28 and 28.

The mattress section 12 has an envelope 11 and a sponge core 31, which is accommodated in the envelope 11. There is provided a valve 32, which is capable of introducing air into the envelope 11, at a corner of the mattress section 12. When the valve 32 is opened, air is automatically introduced into the envelope 11 and absorbed by the core 31, so that the mattress section 12 expands to spread by the self-restoring force of the core 31. After the mattress section 12 fully spreads, the valve 32 is closed to maintain the spread state of the mattress section 12. In this state of closing the valve 32, the mattress section 12 is having an enough elasticity like a cushion, and can be used for a stretcher 10.

In case of accommodating the stretcher 10, the valve 32 is opened to discharge air absorbed from the envelope 11. By winding the mattress section 12 from an opposite longitudinal end to the valve 3, air absorbed in the core 31 and the envelope 11 is discharged from the valve 32.

A mattress, such as one sold under the trademark of THERM-A-REST MATTRESS (Cascade. Inc., U.S.A.), can be employed as the mattress section 12. The mattress section 12 of the present invention is not limited to the THERM-A-REST MATTRESS. Any mattresses, which are made of materials being capable of absorbing air to spread and being wound from a longitudinal end when air is discharged, e.g. as a mere sponge mattress, can be adopted as the mattress section 12.

Note that, an extra valve for introducing air into the envelope 11 may be provided to another corner of the mattress section 12. By providing the valve 32 and the extra valve, air is rapidly introduced into and discharged from the envelope 11. Therefore, the stretcher 10 can be rapidly prepared, for example, in an emergency case.

Means for supplying as into the envelope 11, e.g. as cylinders, chemical means, etc., may be set in a longitudinal end section of the envelope 11. In this case, as supplied from the supplying mean spreads the mattress section 12.

Successively, how to use the stretcher 10 will be explained with reference to FIGS. 3–7.

Figure 3:
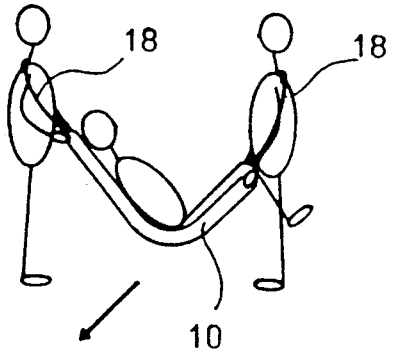
FIG. 3 is an explanation view showing a state of carrying a patient by to carrier persons.

As shown in FIG. 3, a patient (an example of a man to be carried) is laid on the stretcher proper 13. His legs are partially projected from a longitudinal edge of the stretcher proper 13. The patient's body is stably held on the stretcher proper 13 by the holding belts 28 and 28. Carrier persons face each other and respectively shoulder the shoulder belts 18 and 18. The shoulder pads 22 and 22 contact shoulders of the carrier persons. The carrier persons also grip the grip sections 26, 26, 26 and 26 so as to lift the patient on the stretcher 10. In this manner, the patient is held by the mattress section 12 like in man's arms. If the stretcher 10 has enough length, whole legs can be held by the stretcher proper 13.

Figure 4:
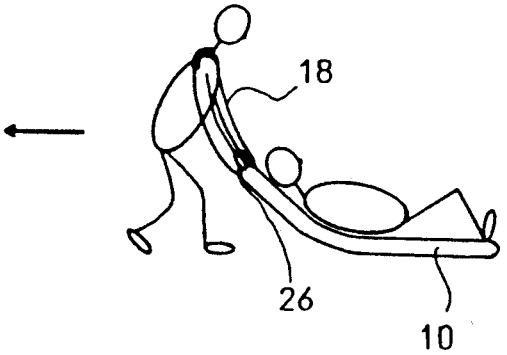
FIG. 4 is an explanation view showing a state of carrying the patient by one carrier person.

In FIG. 4, one carrier person carries the patient. In this case, the patient is laid on the stretcher proper 13. The patient's knees are bent. The carrier person shoulders the shoulder belt 18 and grips the grip sections 26 and 26 so as to drag the patient on the stretcher 10. The mattress section 12 has enough elasticity, so that shock to the patient can be absorbed by the mattress section 12. And the mattress section 12 is covered with the water-proof cover section 14, so the patient does not et wet even if a floor is wet.

Figure 5:
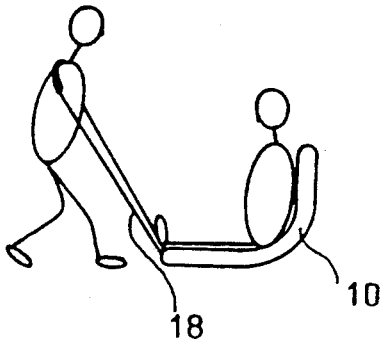
FIG. 5 is an explanation view showing a state of carrying the patient by the carrier person.

In FIG. 5, the patient sits on the stretcher proper 13. The carrier person pulls the shoulder belt 18 toward himself so as to drag the patient on the stretcher 10. When the shoulder belt 18 is pulled toward him, a rear part, with respect to the patient, of the stretcher proper 13 is elevated as shown in FIG. 5.

Figure 6:
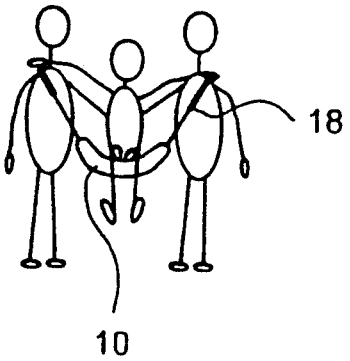
FIG. 6 is an explanation view showing a state of carrying the patient by two carrier persons.

In FIG. 6, the patient sits on the stretcher proper 13 and faces forward. Carrier persons also face forward and respectively shoulder each shoulder belt 18 and 18. The patient is lifted and carried.

In the present invention, the stretcher 10 has the elastic mattress section 12 like a cushion and the water-proof cover section 14. So after the patient is carried to a destination, the stretcher 10 can be used for a comfortable bed, and the patient does not get wet even if the stretcher 10 is left on a wet floor. In an emergency case, the patient on the stretcher 10 can be slid on an emergency sliding way.

Figure 7:
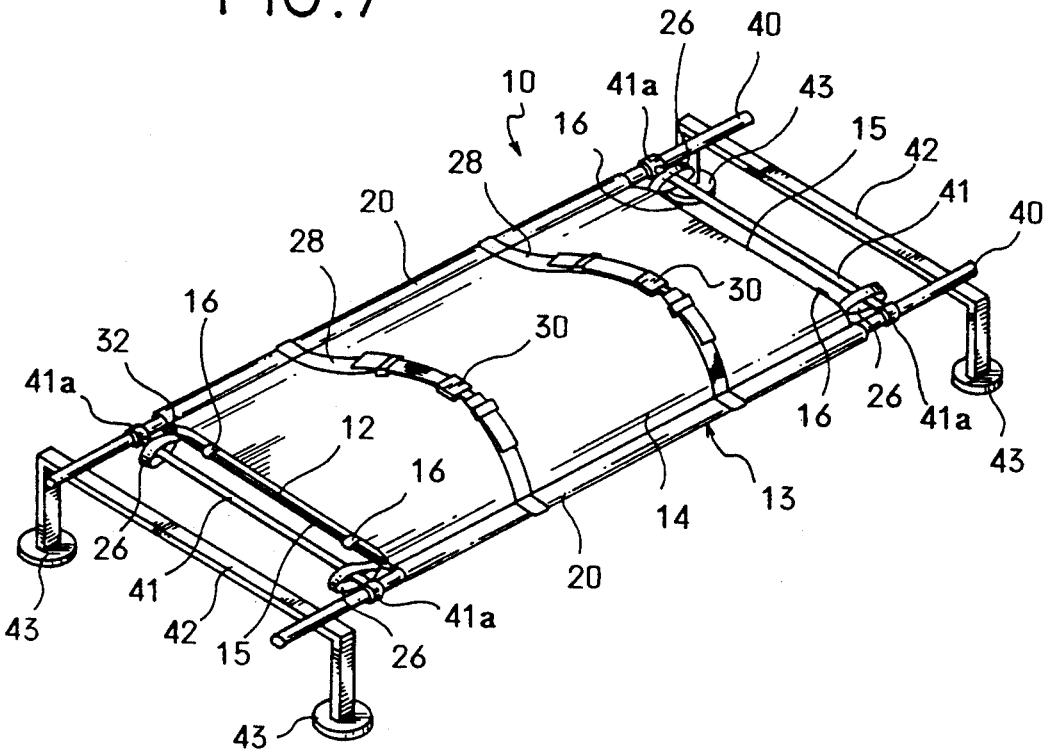
FIG. 7 is an explanation view showing a state of using the stretcher as a simple bed.

Furthermore, as shown in FIG. 7, shafts 40 and 40 can be pierced through the belt holders 20 and 20 instead of the shoulder belts 18 and 18. In his case, the belt holders 20 and 20 are regarded as shaft holders, and the stretcher 10 can be used for not only the conventional stretcher but also a simple bed. The structure shown in FIG. 7 is a simple bed. In FIG. 7, supporting legs 42 and 42, which are an example of supporting means for supporting the shafts 40 and 40, are formed into an inverted U shape. There are provided disks 43, 43, 43 and 43 at lower end sections of the supporting legs 42 and 42. There are spanned holding rods 41 and 41, which are an example of holding means for securing the span between the shafts 40 and 40 at predetermined distance, between the shafts 40 and 40. The holding rods 41 and 41 are pierced through the looped grip sections 26, 26, 26 and 26. There are grooves on each bottom face of end sections 41*a*, 41*a*, 41*a* and 41*a* of the holding rods 41 and 41. The grooves of the holding rods 41 and 41 are engaged with the shafts 40 and 40.

Note that, the supporting means and the holding means are not limited to above described structures, various structures, e.g. collapsible legs, can be applied.

Figure 8:
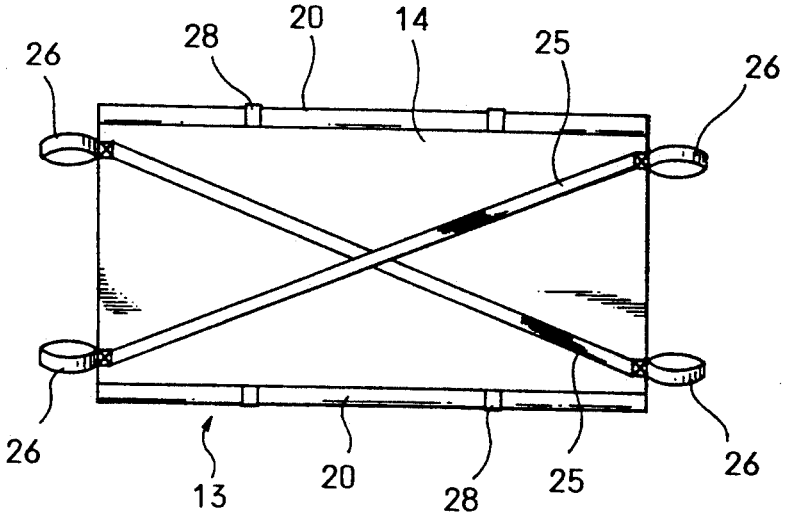
FIG. 8 is a bottom view of another cover section.

FIG. 8 shows a bottom view of the stretcher proper 13 of another embodiment without showing the shoulder belts 18 and 18. On the bottom face, two belts 2 and 2 are crossed to diagonally connect the grip sections 26, 26, 26 and 26. The grip sections 26, 26, 26 and 26 are sewed to each end of the belts 25 and 25. The belts 25 and 25 are sewed on the bottom face of the stretcher proper 13. With this structure, during the patient is carried, the belts 25 and 25 prevent the stretcher proper 13 from transforming into a steep V shape, so that the patient cam be stably carried.

Figure 9:
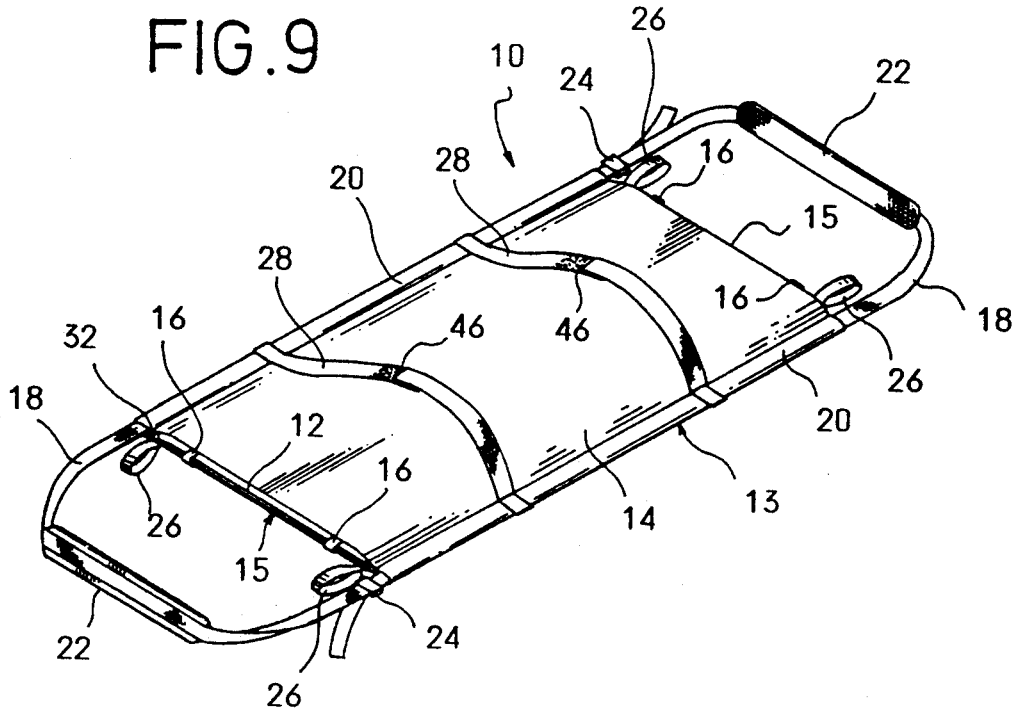
FIG. 9 is a perspective view of a stretcher having holding belts with plane fasteners.

In an embodiment shown in FIG. 9, plane fasteners 46 and 46, each of which is capable of fastening and peeling off, are provided to the holding belts 28 and 28 instead of the buckles 30 and 30. By using the plane fasteners 46 and 46, the patient can be rapidly held or released. Furthermore, by changing positions of the plane fasteners 46 and 46, tightness thereof can be adjusted easily.

Figure 10:
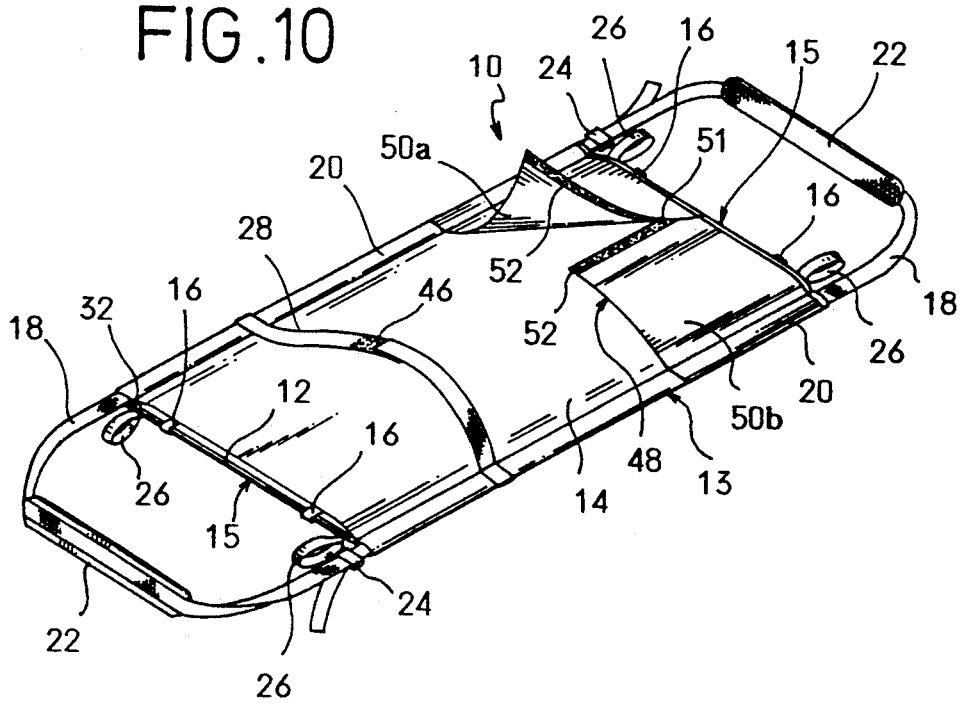
FIG. 10 is a perspective view of a stretcher having a leg-bag section provided at a longitudinal end of the cover section.

In FIG 10, the stretcher 10 has a leg-bag section 48 and a holding belt 28. The leg-bag section 48 is capable of accommodating the patient's legs. The leg-bag section 48 is provided at one longitudinal end of the cover section 14. The leg-bag section 48 is made of two pieces of sheet cloth 50*a* and 50*b*. A side edge and an end edge of each cloth 50*a* and 50*b* are sewed on the cover section 1. With this structure, the leg-bag section 48 has a first openable section 51 in the center part. There are provided plane fasteners 52 and 52, which are an example of first fastening means for opening and closing the first openable section 51, on edges of the first openable section 51. Therefore, the leg-bag section 48 can be opened at the first openable section 51. By plane fasteners 52 and 52, the leg-bag section 48 can be opened easily, and the legs of the patient, who are laid on the stretcher 10, are stably held in the leg-bag section 4.

Figure 11:
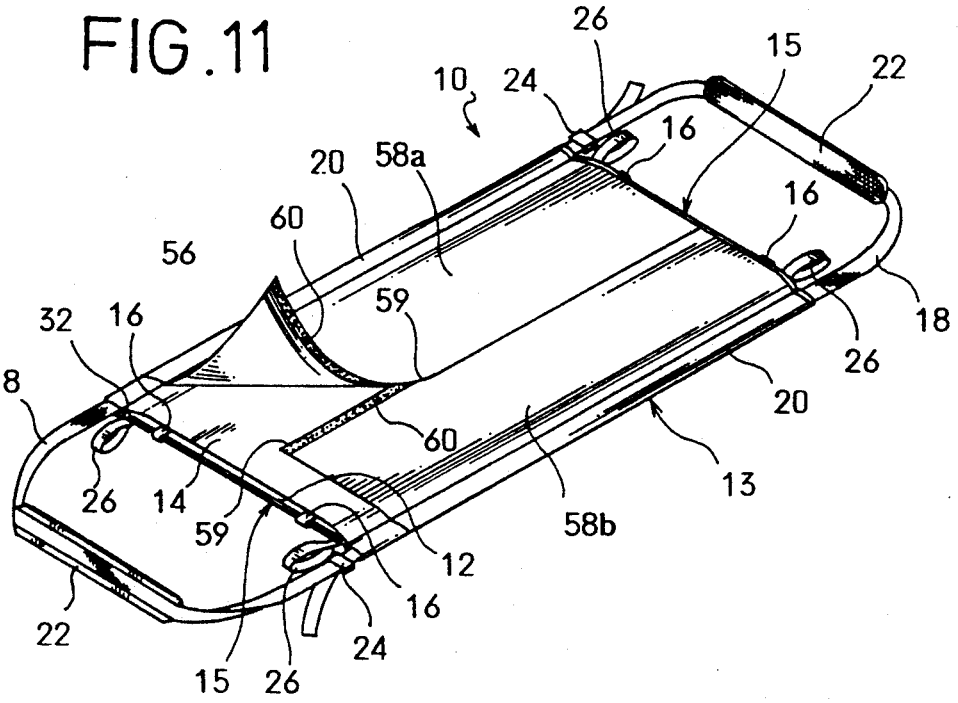
FIG. 11 is a perspective view of a stretcher having a body-bag section provided on an upper face of the cover section.

In FIG. 11, the stretcher 10 has a boy-bag section 56 larger than the leg-bag section 48. The stretcher 10 may have the holding belts 28 and 28 shown in FIG. 1. The structure of the body-bag section 56 is the same as that of the leg-bag section 48. The body-bag section 56 is capable of accommodating the whole patient's. The body-bag section 66 is provided on an upper face of the cover section 14. The body-bag section 56 is made of two pieces of sheet cloth 58*a* and 58*b*. A side edge and an end edge of each cloth 58*a* and 58*b* are sewed on the cover section 14. With this structure, the body-bag section 56 has a second openable section 59 in the center part. There are provided plane fasteners 60 and 60, which are an example of second fastening means for opening and closing the second openable section 59, on edges of the second openable section 59. With this structure, the whole body of the patient, who are laid on the stretcher 10, are stably accommodated in the body-bag section 56 by fastening the plane fasteners 60 and 60.

Figure 12:
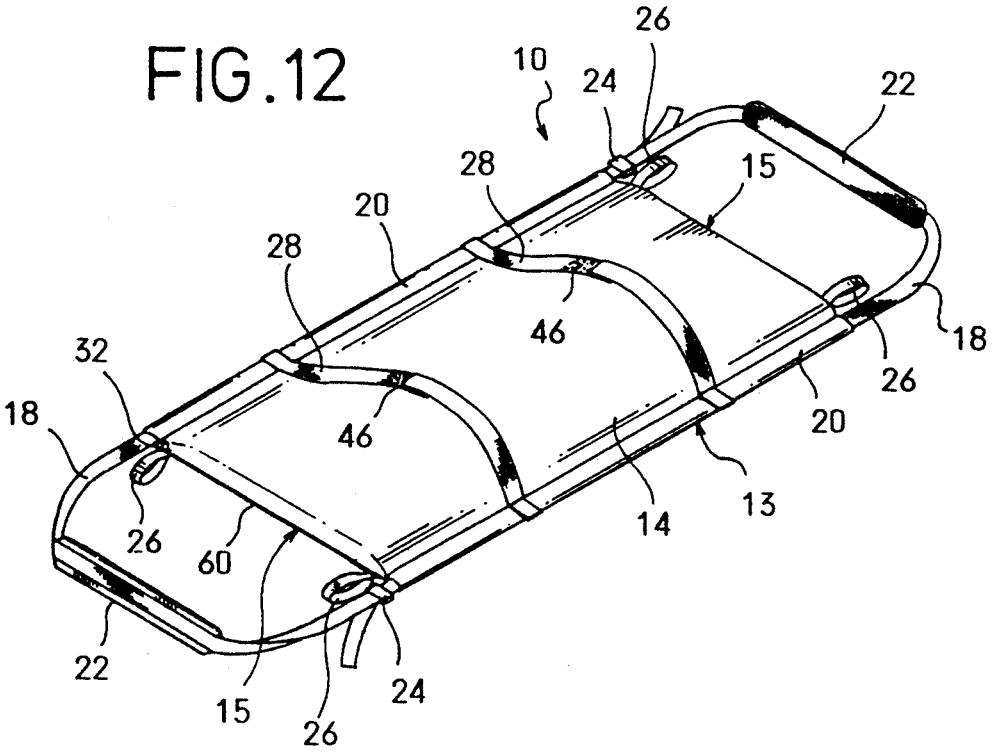
FIG. 12 is a perspective view of a stretcher having a plane fasteners provided on an edge of an opening, which is opened on a transverse edge of the cover section.

In the foregoing embodiments, there are provided holders 16, 16, 16 and 16, which hold the mattress section 12 in the cover section 14, on edges of the openings 15 and 15. However, as shown in FIG. 12, pane fasteners 60 and 60 can be adopted instead of the holders 16, 16, 16 and 16. Furthermore, line fasteners (zippers) also can be adopted instead of the plane fasteners 60 and 60. By using these fastening means, e.g. plane fasteners, line fasteners, etc., the mattress section 12 can be easily and rapidly set in and pull out from the cover section 14.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A stretcher, for use in the transportation of an individual, comprising:

a mattress section having a rectangular shape, said mattress section being made of a material, which is capable of absorbing air, said mattress section being capable of spreading by absorbing air and being wound from a longitudinal end when air is discharged;

a cover section for accommodating said mattress section, said cover section having a rectangular shape, having spaced apart parallel longitudinal edges and spaced apart parallel longitudinal ends;

belt holder channels being provided only on both longitudinal edges of said cover section; and a single belt being run through all said belt holders, said belt being formed in a loop, said belt including stretcher support portions at either longitudinal end of said stretcher, said support sections being spaced apart from said longitudinal ends and extending from said belt holder on one longitudinal edge of said cover section to the belt h older on the other longitudinal edge of said cover section.

2. The stretcher according to claim 1, further comprising a grip section being provided at a longitudinal end of said cover section.

3. The stretcher according to claim 1, further comprising grip sections being provided at both longitudinal ends of said cover section.

4. The stretcher according to claim 1, further comprising:

four grip sections being respectively provided at each corner of said cover section, along said longitudinal ends of said cover section, said grip sections being divided into two pairs with said pairs comprising grip sections disposed at diagonally opposite corners of said cover section, each pair of said grip sections, which are diagonally provided, being connected by a connecting belt, which is fixed on said cover section.

5. The stretcher according to claim 4, wherein said connection belts are sewed on a bottom face of said cover section.

6. The stretcher according to claim 1, further comprising a leg-bag section for accommodating man's legs, said leg-bag section being provided at one longitudinal end of said cover section.

7. The stretcher according to claim 6, wherein said leg-bag section has a first openable section in the center part, and further comprising first fastening means for opening and closing said first openable section, said first fastening means being provided on an edge of said first openable section.

8. The stretcher according to claim 1, further comprising:

a body-bag section for accommodating man's body, said body-bag section being provided on an upper face of said cover section, said body-bag section having a second openable section in the center part; and second fastening means for opening and closing said second openable section, said second fastening means being provided on an edge of said second openable section.

9. The apparatus of claim 1 further comprising bed conversion means for converting said stretcher into an emergency bed comprising:

said belt holder channels being provided for use as shaft holders;

a pair of shafts being pierced through said shaft holders;

supporting means for supporting said shafts a distance above the ground; and holding means for securing the span between said shafts at predetermined distance said holding means being disposed generally parallel to said longitudinal ends of said cover means.

* * * * *

UNITED STATES PATENT AND TRADEMARK OFFICE

CERTIFICATE OF CORRECTION

PATENT NO. : 5,317,770

DATED : 06/07/94

INVENTOR(S) : Kazutoshi Sakurai

It is certified that error appears in the above-identified patent and that said Letters Patent is hereby corrected as shown below:

In Col. 1, line 54, after "a" delete "bet" and insert -- belt --.

In Col. 1, line 54, after "the" delete "bet" and insert -- belt --.

In Col. 1, line 56, after "no" delete "ion" and insert -- long --.

In Col. 1, line 64, after "of" delete "he" and insert -- the --.

In Col. 2, line 4, after "legs" delete "provide" and insert -- provided --.

In Col. 2, line 12, after "section" delete "or" and insert -- for --.

In Col. 2, line 13, after "The" delete "body-ba" and insert -- body-bag --.

In Col. 2, line 37, after "invention" delete "wil" and insert -- will --.

In Col. 2, line 47, after "by" delete "to" and insert -- two --.

In Col. 2, line 51, after "by" delete "the" and insert -- one --.

UNITED STATES PATENT AND TRADEMARK OFFICE

CERTIFICATE OF CORRECTION

PATENT NO. : 5,317,770

DATED : 06/07/94

INVENTOR(S) : Kazutoshi Sakurai

It is certified that error appears in the above-identified patent and that said Letters Patent is hereby corrected as shown below:

In Col. 3, line 11, after "section" delete "1" and insert -- 14 --.

In Col. 3, line 14, before "are closed" delete "1" and insert -- 14 --.

In Col. 3, line 18, after "holder" insert -- channels --.

In Col. 3, line 23, after "22 and 22" insert -- at stretcher support portions --.

In Col. 3, line 59, after "valve" delete "3" and insert -- 32 --.

In Col. 3, line 63, after "Cascade" delete the period and insert a comma.

In Col. 4, line 11, after "supplying" delete "as" and insert -- gas --.

In Col. 4, line 11, after "e.g." delete "as" and insert -- gas --.

In Col. 4, line 13, after "case" delete "as" and insert -- gas --.

In Col. 4, line 39, after "not" delete "et" and insert -- get --.

In Col. 4, line 61, after "In", delete "his" and insert -- this --.

UNITED STATES PATENT AND TRADEMARK OFFICE

CERTIFICATE OF CORRECTION

PATENT NO. : 5,317,770

DATED : 06/07/94

INVENTOR(S) : Kazutoshi Sakurai

It is certified that error appears in the above-identified patent and that said Letters Patent is hereby corrected as shown below:

In Col. 5, lines 16-17, after "two belts" delete "2 and 2" and insert -- 25 and 25 --.

In Col. 5, line 41, after "section" delete "1" and insert -- 14 --.

In Col. 5, line 50, after "section" delete "4" and insert -- 48 --.

In Col. 5, line 57, after "section" delete "66" and insert -- 56 --.

In Col. 6, line 6, after "12" delete "pane" and insert -- plane --.

In Col. 6, line 43, after "belt" delete "h older" and insert -- holder --.

In Col. 6, line 63, after "said" delete "connection" and insert -- connecting --.

Signed and Sealed this

Twentieth Day of September, 1994

*Attest:*

*Attesting Officer*

Bruce Lehman

BRUCE LEHMAN

*Commissioner of Patents and Trademarks*